US007442894B2

(12) United States Patent
Villain et al.

(10) Patent No.: US 7,442,894 B2
(45) Date of Patent: Oct. 28, 2008

(54) ELECTRICAL SWITCH HAVING A VARIABLE RETURN FORCE

(75) Inventors: Jean-Christophe Villain, Dole (FR); Michel Cour, Sampans (FR)

(73) Assignee: CoActive Technologies, Inc., Newton, MA (US)

( * ) Notice: Subject to any disclaimer, the term of this patent is extended or adjusted under 35 U.S.C. 154(b) by 0 days.

(21) Appl. No.: 12/042,858

(22) Filed: Mar. 5, 2008

(65) Prior Publication Data

US 2008/0217155 A1 Sep. 11, 2008

(30) Foreign Application Priority Data

Mar. 5, 2007 (FR) ..... 07 53636

(51) Int. Cl.
*H01H 3/14* (2006.01)

(52) U.S. Cl. ..... 200/344; 200/406; 200/516; 200/341

(58) Field of Classification Search ..... 200/520, 200/516, 517, 406, 341, 344, 345, 16 R, 16 A, 200/16 B, 16 C, 16 D
See application file for complete search history.

(56) References Cited

U.S. PATENT DOCUMENTS 3,773,998 A * 11/1973 Seeger et al. ..... 200/517
4,864,085 A * 9/1989 Hanajima et al. ..... 200/5 A
5,118,912 A 6/1992 Itabashi
5,488,210 A * 1/1996 Shigetaka et al. ..... 200/344
6,096,989 A * 8/2000 Kinoshita ..... 200/345
6,107,586 A 8/2000 Takeuchi
6,545,238 B2 * 4/2003 Hsu et al. ..... 200/344
6,755,582 B2 * 6/2004 Won ..... 400/490
6,984,797 B2 * 1/2006 Morita et al. ..... 200/314
7,022,928 B2 * 4/2006 Watanabe et al. ..... 200/406
7,034,237 B2 * 4/2006 Ferri et al. ..... 200/341
7,105,761 B2 * 9/2006 Masuda et al. ..... 200/406

* cited by examiner

*Primary Examiner*—Michael A Friedhofer
(74) *Attorney, Agent, or Firm*—Pepper Hamilton LLP

(57) ABSTRACT

An electrical switch system may include a contact-bearing support configured to delimit a recess in a substantially horizontal bottom, wherein at least two fixed electrical contacts are positioned in the recess. Additionally, the electrical switch system may include at least one dome-shaped first triggering device configured to be elastically deformable from a top rest position to form an electrical link between the at least two fixed electrical contacts. The electrical switch system may also include an actuating push-button mounted to be displaced substantially vertically downward relative to the support. Further, the electrical switch system may include a mechanism configured to return the push-button to the rest position and an elastic element configured to exert an elastic force on the push-button, wherein the elastic force is directed upward when the push-button is displaced downward beyond a contact position.

17 Claims, 8 Drawing Sheets

ELECTRICAL SWITCH HAVING A VARIABLE RETURN FORCE

RELATED APPLICATIONS AND CLAIM OF PRIORITY

This patent application claims priority to French Application No. 0753636, filed Mar. 5, 2007, the disclosure of which is incorporated herein by reference in its entirety.

NOT APPLICABLE

BACKGROUND

Push-button technology may be used in a variety of circumstances such as in a computer keyboard or in a camera. For example, U.S. Pat. No. 5,118,912 describes a switching device having at least one contact member to be moved by an operation button member when operation button member is depressed. The patent also describes an elastic member arranged opposite the contact member with respect to the conductive member for being elastically deformed when the operation button member is depressed after the contact member had been contacted with the conductive member.

SUMMARY

An electrical switch may include a contact-bearing support, which delimits a recess, in the bottom of which are positioned at least two fixed electrical contacts. The electrical switch may include at least one generally dome-shaped triggering device which is elastically deformable, in a roughly vertical direction, from a top rest position to make an electrical link between the fixed contacts. The electrical switch may include an actuating push-button mounted to move roughly vertically downward relative to the support, from a top rest position in which the push-button is not in contact with the triggering device, to a number of successive positions, including a first position of contact with the triggering device, and a second actuating position in which it acts on the triggering device so that the triggering device is elastically deformed to make the electrical link between the fixed contacts. The electrical switch may include a return mechanism configured to return the actuating push-button to a top rest position, which exerts on the push-button an elastic return force directed substantially vertically upward.

In an embodiment, the actuating push-button's position may correspond to its displacement from a top rest position to a contact position. In an embodiment, the user may be able to exert a reduced force on the switch without immediately acting on the triggering device. This makes it possible to have a so-called "dead" travel avoiding any involuntary operation of the switch.

However, after the switch is actuated, that is, when the triggering device has been deformed by the push-button, the triggering device may abut against the bottom of the support and the push-button may continue to exert a force on the triggering device as long as the user maintains a force on the switch. By maintaining a force to maintain the triggering device in the deformed position, the user may exert a force of variable amplitude on the push-button which can damage the triggering device by crushing the device when the amplitude of this force is too great.

In an embodiment, it may be possible to limit the forces exerted on the triggering device when the push-button is in a position situated beyond the actuating position.

In an embodiment, a switch may include an elastic element which is able to exert on the ting push-button an elastic force in addition to an elastic return force exerted by the mechanism configured to return, and which is directed upward, when the push-button is displaced downward beyond a first contact position.

In an embodiment, the support may include an elastically deformable portion positioned under a triggering device to enable the push-button to slide downward, beyond the actuating position of the triggering device, to prevent trembling of the appliance on which the switch is mounted. However, this downward displacement of the push-button may provoke an additional deformation of the triggering device which can damage the triggering device.

In an embodiment, the elastic element may be subjected to an initial stress at least when the push-button is situated vertically above an intermediate contact position. The elastic element may be positioned between a triggering device and the actuating push-button so that the elastic element is elastically deformed when the push-button moves beyond an actuating position. The elastic element may form an elastic lever for transmitting the action of the push-button to the triggering device, which is bearing on the support, at least when the push-button is in a vertical position situated vertically downward beyond the first contact position. The elastic element may be mounted to move relative to the support from a rest position to which it is elastically returned to a contact position associated with the contact position of the push-button, in which the elastic element is bearing on the support and from which the elastic element is able to be elastically deformed when the push-button is displaced beyond the actuating position. The elastic element may be driven displacement-wise relative to the support from a rest position to the contact position via the actuating push-button.

In an embodiment, an elastic return mechanism may include an elastic return device which exerts on the push-button the elastic return force, and which returns the elastic element to a rest position. The elastic element may be positioned between the push-button and the elastic return device. The elastic element and the elastic return device may be produced in one piece by cutting and/or bending a piece of elastic material. The stiffness of the elastic element may be greater than the stiffness of the elastic return device. The elastic element may be in permanent contact with the support and with the triggering device. The elastic element may exert on the triggering device a force, the value of which is determined so as to not make the electrical link between the fixed contacts. The elastic element may be directly in contact with the triggering device to transmit the force of the actuating push-button to provoke the deformation of the triggering device.

In an embodiment, the elastic element may be in contact with the triggering device via a damping element to transmit the force of the actuating push-button to the triggering device. The elastic element may include a first end which is able to bear against the triggering device and a second end which is able to bear against the support. The push-button may be able to bear on an intermediate portion of the elastic element situated between the first end and the second end of the elastic element, when it slides downward, from a first contact position. The triggering device may form a disengagable endstop of the actuating push-button in a first contact position, which is able to change state when the action of the push-button on the triggering device involves exerting a force of a value greater than a predetermined threshold value. The switch may include two triggering devices on each end of the elastic element and the threshold value associated with one triggering device, provoking the change of state of the triggering device which is different from the threshold value associated with the other triggering device.

BRIEF DESCRIPTION OF THE DRAWINGS

Aspects, features, benefits and advantages of the embodiments described herein will be apparent with regard to the following description, appended claims, and accompanying drawings where:

DETAILED DESCRIPTION

Before the present methods are described, it is to be understood that this invention is not limited to the particular systems, methodologies or protocols described as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Unless defined otherwise all technical and scientific terms used herein have the same meanings as commonly understood by one of ordinary skill in the art. As used herein, the term "comprising" means "including, but not limited to ".

As used herein, the use of the terms "right" and "left" are non-limiting and the elements may be depicted in any order.

Figure 1:
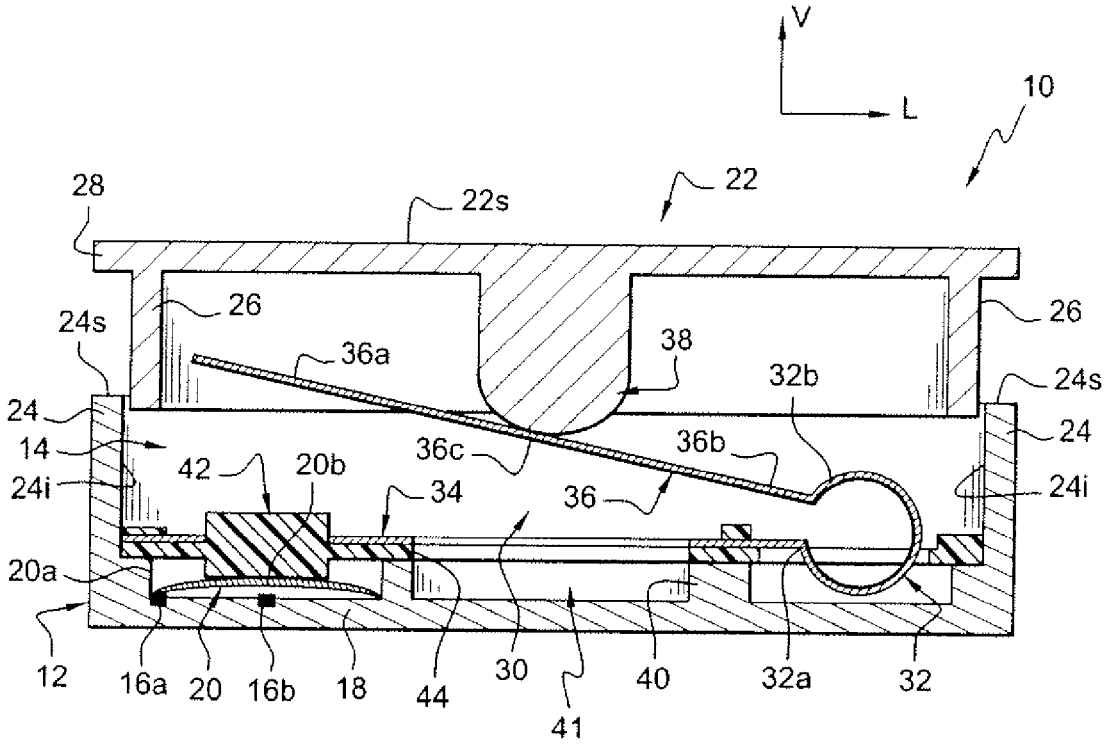
FIG. 1 depicts a diagrammatic representation in cross section on a vertical plane of a switch according to an embodiment, in which the actuating push-button is in the top rest position.

Additionally, FIG. 1 includes "V" and "L" references to the vertical and longitudinal directions respectively. However, these directions are non-limiting and the device and elements of the device may be depicted in any configuration.

FIGS. 1-4 depict an electrical switch 10. The electrical switch 10 may include a bottom contact-bearing support 12 which is produced by moulding insulating plastic material. In an embodiment, the material may be in rectangular parallelepiped form. The support 12 may delimit an upward opening recess 14 and may be produced by the over moulding of plastic material on electrical contacts 16*a*, 16*b*, each of which has a connection end 17 (represented in FIGS. 13 and 14), which extends outside the support 12, to enable the switch 10 to be mounted on and connected to a printed circuit board. In an embodiment, the support 12 may include a horizontal bottom 18 in which the electrical contacts 16*a*, 16*b* are positioned.

To make an electrical link between the electrical contacts 16*a*, 16*b*, the switch 10 may include a triggering device 20. In an embodiment, the triggering device 20 may be made of an electrically conductive material. The triggering device 20 may simultaneously contact both electrical contacts 16*a*, 16*b*.

In an embodiment, the triggering device 20 may be of a substantially convex form and domed upward. The triggering device 20 may be in permanent contact with a first electrical contact 16*a*, at the level of the peripheral edge 20*a*. The central peak 20*b* of the triggering device 20 may be situated in line and vertically away from the second electrical contact 16*b*. The triggering device 20 may be elastically deformable so that the peak 20*b* may be displaced vertically downward to come into contact with the second electrical contact 16*b*. Consequently, an electrical link may be made between the two electrical contacts 16*a*, 16*b*.

In an embodiment the elastic deformation of the triggering device 20 may be provoked by an actuating push-button 22. The actuating push-button 22 may be mounted to move vertically relative to the support 12 from a top rest position depicted in FIG. 1 to a number of consecutive bottom actuating positions depicted in FIGS. 2-4.

The support 12 may include external vertical walls 24 delimiting the recess 14. The internal faces 24*i*, together with the external vertical walls or faces 26 of the push-button 22, may produce a guideway for the push-button 22 to slide vertically relative to the support 12.

Figure 4:
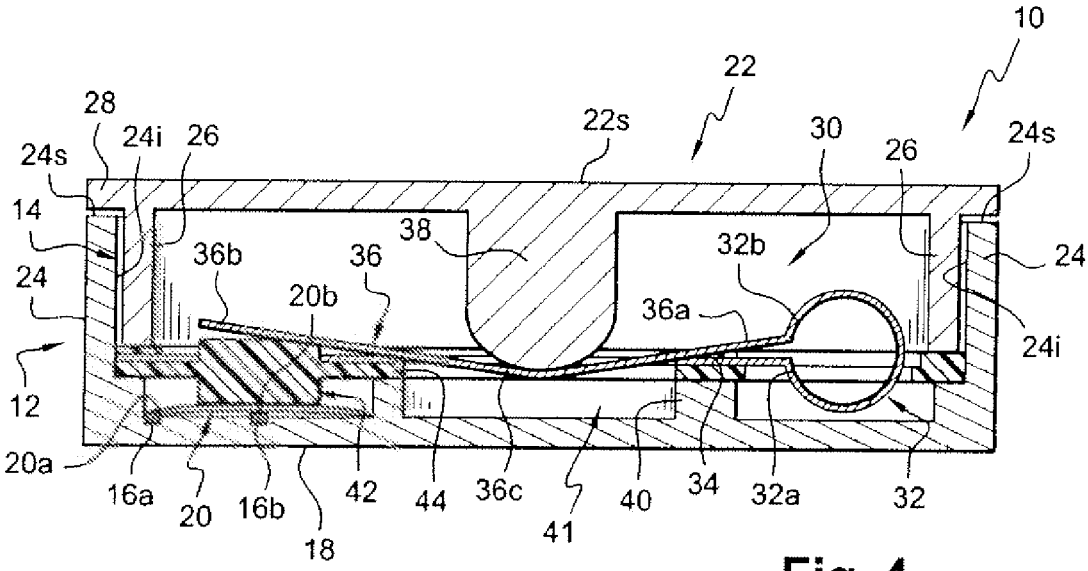
FIG. 4 depicts a view similar to that of FIG. 1, in which the push-button is in a bottom position situated beyond the second actuating position, and in which the elastic element and the damping element are elastically deformed according to an embodiment.

The push-button 22 may include an external circular collar 28 which extends in a horizontal plane and can abut downward against the top end 24*s* of each vertical wall 24 to form an endstop for the push-button 22 in an extreme bottom actuating position as depicted in FIG. 4. The vertical downward sliding of the push-button 22 may occur when a user acts on the horizontal top face 22*s* of the push-button 22 by applying a force directed substantially vertically downward.

The switch 10 may also include a return mechanism 30 that elastically returns the push-button 22 to its top rest position, which may oppose the force of the user on the push-button 22. The return mechanism 30 may include an elastic return device 32. The elastic return device 32 may be positioned between the push-button 22 and the support 12. The elastic return device 32 may be elastically deformed to a lesser or greater extent according to the vertical position of the push-button 22.

In an embodiment, an elastic return force may be directed substantially vertically upward for the push-button 22.

In FIGS. 1-4, the elastic return device 32 may form a deformable loop with a first end 32*a* and a second end 32*b*. The first end 32*a* may be fixed to the bottom 18 of the support 12 via a first fixed blade 34 which may be mounted on the bottom 18 of the support 12. The second end 32*b* may be linked to the push-button 22 via a second moving blade 36 which transmits the return force from the elastic device 32 to the push-button 22. In an embodiment, the push-button 22 may include a bottom actuating digit 38 which presses downward on the second blade 36.

When the push-button 22 is in its top rest position, as depicted in FIG. 1, the push-button 22 may be situated vertically away from the triggering device 20. In an embodiment, the push-button 22 may not act on the triggering device 20. In an embodiment, the triggering device 20 may not be deformed. The peak of the triggering device 20*b* may remain situated away from the second electrical contact 16*b* and the electrical link between the two electrical contacts 16*a*, 16*b* may not be made.

A user may displace or slide vertically downward the push-button 22 relative to the support 12. The push-button 22 may provoke the elastic deformation of the elastic device 32 and may drive the second blade 36 downward. As the push-button 22 moves away from its rest position, when sliding downward, the elastic deformation of the elastic device 32 may increase. Consequently, the value of the return force exerted by the elastic device 32 on the push-button 22 may increase. Thus, the user may exert a force of increasing amplitude on the push-button 22 to provoke a downward distancing of the push-button 22 from its rest position.

In a first intermediate contact position (not represented), the push-button 22 may come into contact with the triggering device 20 via the second blade 36, at the level of the peak 20*b* of the triggering device 20. In an embodiment, the triggering device 20 may be produced in such a way that it forms a disengagable endstop of the push-button 22 in the first intermediate position. The triggering device 20 can change state when the force exerted by the user on the push-bottom 22 becomes greater than a predetermined threshold value. Thus, as long as the triggering device 20 has not changed state, that is when the value of the force exerted by the user on the push-button 22 is less than the threshold value, the push-button 22 may be maintained in the first contact position.

Figure 2:
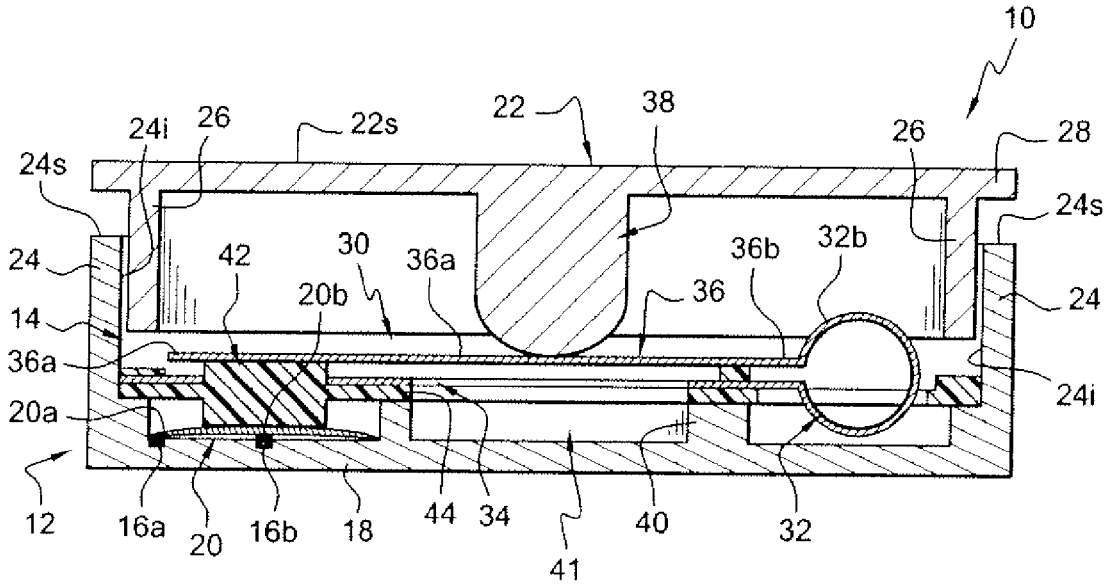
FIG. 2 depicts a view similar to that of FIG. 1, in which the push-button is in a triggering device actuating position according to an embodiment.

When the user feels resistance to the displacement of the push-button 22, the user may increase the force on the push-button 22 to be able to provoke the change of state of the triggering device 20. The change of state of the triggering device 20 may result in a rapid vertically downward displacement of the peak 20*b* of the triggering device 20. As a result, the peak 20*b* become into contact with the second fixed contact 16*b*, as depicted in FIG. 2. This rapid displacement of the peak 20*b* of the triggering device 20 may be accompanied by a rapid downward displacement of the push-button 22. The user may feel a rapid reduction in the resistant force at the same time as the push-button 22 is rapidly being downwardly displaced. This tactile sensation may then be interpreted by the user as representative of the actuation of the switch 10.

After the change of state of the triggering device 20, the peak 20*b* of the triggering device 20 may abut downward against the second electrical contact 16*b*. Once the peak 20*b* triggering device 20 can no longer be displaced downward, the triggering device 20 cannot be further deformed.

After the change of state of the triggering devices the user may sustain his force on the push-bottom 22 to maintain the electrical link between the two fixed electrical contacts 16*a*, 16*b*. In an embodiment, the amplitude of the force on the part of the user may be relatively high and may possibly reach a value high enough for the triggering device 20 to be damaged by compression against the bottom 18 of the recess 14.

Figure 3:
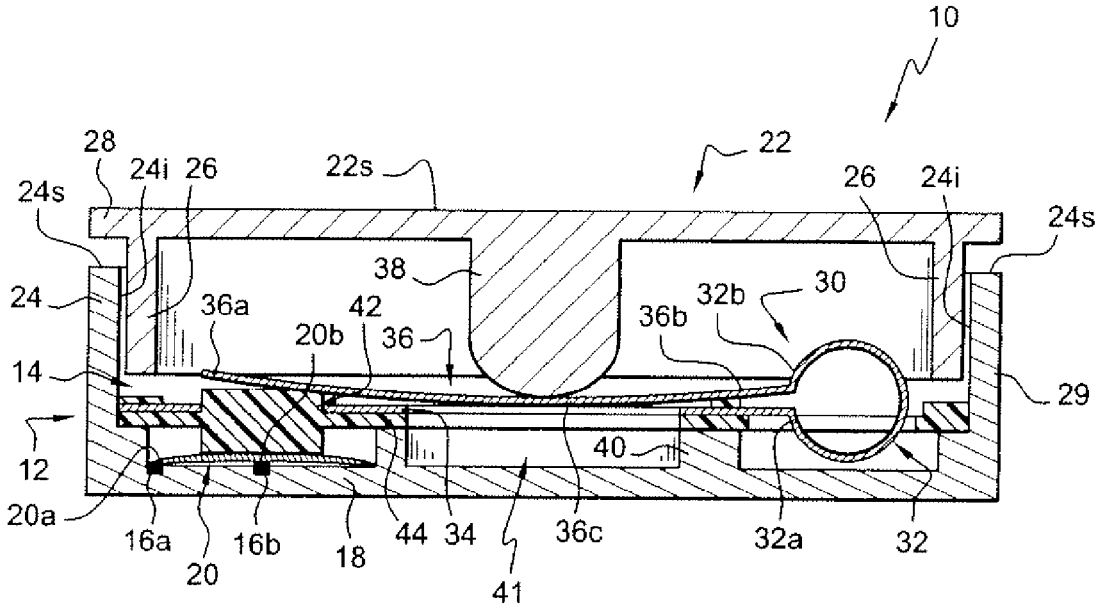
FIG. 3 depicts a view similar to that of FIG. 1, in which the push-button is in a bottom position situated beyond a second actuating position, and in which the elastic element is elastically deformed according to an embodiment.

To limit the risks of damaging the triggering device 20, the second blade 36 may form a lever transmitting forces and movement from the push-button 22 to the triggering device 20. The push-button 22 may be produced in such a way that the part of the push-button 22 which acts on the triggering device 20, such as the bottom digit 38, may be offset horizontally and/or laterally relative to the peak 20*b* of the triggering device 20. In an embodiment, the bottom digit 38 may be offset longitudinally to the right of the peak 20*b* of the triggering device 20. In an embodiment, the bottom digit 38, may be offset longitudinally to the left of the peak 20*b* of the triggering device 20. Thus, when the push-button 22 is in its first intermediate contact position, the second blade 36 may be in contact with both the peak 20*b* of the triggering device and with an associated portion 40 of the bottom 18 of the recess 14. As depicted in FIGS. 2-4, a first end 36*a* of the second blade 36 may come into contact with the peak 20*b* of the triggering device 20, and the second end 36*b* of the second blade 36 may come into contact with the associated portion 40 of the bottom 18 of the recess 14.

In an embodiment, the push-button 22 may be in contact with the second blade 36 at the level of an intermediate portion 36*c* of the second blade 36 which may be located substantially in the middle of the second blade 36. In an embodiment, the lower digit 38 may press downward against the intermediate portion 36*c* of the second blade 36. In an embodiment, the amplitude of the force transmitted by the second blade 36 from the push-button 22 to the triggering device 20 may be reduced.

As depicted in FIG. 2, the second blade 36 may be elastically deformable to enable the push-button 22 to slide vertically downward beyond the intermediate actuating position. This may make it possible to obtain an additional downward displacement of the push-button 22 without the triggering element 20 being additionally deformed.

Thus, as depicted in FIG. 3, when the push-button 22 is displaced downward beyond the actuating position, the second blade 36 may still bear against a portion 40 of the bottom 18 of the recess 14 at the level of its second end 36*b* and against the peak 20*b* of the triggering device 20 at the level of its first end 36*a*. The two ends 36*a*, 36*b* of the second blade 36 may be vertically immobile. However, the central portion 36*c* of the second blade 36 may be elastically deformed downward. In an embodiment, the central portion 36*c* of the second blade 36 may be elastically deformed downward by flexing between two fixed supports, thus enabling the push-button 22 and the central portion 36*c* of the second blade 36 to be displaced vertically downward.

When elastically deformed, the second blade 36 may exert an additional return force on a digit 38 of the push-button 22 which may be added to the return force exerted by the elastic device on the push-button 22. In an embodiment, the additional force may be directed vertically upward. The additional force may be produced by the second blade 36 on the push-button 22 as a result of its elastic deformation. The amplitude of the additional force may vary according to the elastic deformation of the second blade 36. In an embodiment, the more the push-button 22 is displaced downward, the more the second blade 36 is deformed, and, consequently, the greater the amplitude of the additional force.

To provoke a downward displacement of the push-button 22 beyond its actuating position, a user may exert a force on the push-button 22. The amplitude of the force may correspond to the combination of the amplitude of the return force produced by the elastic device 32 and the amplitude of the force produced by the second blade 36.

The general stiffness of the resisting means, which opposes the downward displacement of the push-button 22, may become greater when the push-button 22 passes the intermediate actuating position. Consequently, the resistance felt by the user may increase which may make it possible to limit the amplitude of the displacement of the push-button 22.

In an embodiment, to maintain the electrical link between the two fixed electrical contacts 16*a*, 16*b*, the user may exert a permanent force on the push-button 22 so as to limit the vertical displacements of the push-button 22 relative to the support 12 by avoiding excessively varying the amplitude of its force on the push-button 22.

Since the general stiffness of a resisting mechanism may increase when the push-button passes the intermediate actuating position, the amplitude of the displacement of the push-button 22 corresponding to a small variation of force exerted by the user may be greatly reduced relative to the displacement amplitude of the push-button 22 on the resisting mechanism's displacement from the rest position to the intermediate contact position.

To enable the downward displacement of the push-button 22 and the central portion 36*c* of the second blade 36, the bottom 18 of the support 12 may include a central void 41 which is formed so as to be passed through by the digit 38 of the push-button 22 and by the central portion 36*c* of the second blade 36.

In an embodiment, an additional elastic element 42, forming an elastic endstop, may be positioned vertically between the triggering device 20 and the first end 36*a* of the second blade 36. The elastic endstop 42 may also be able to be deformed on the downward displacement of the push-button 22 beyond the intermediate actuating position.

Figure 5:
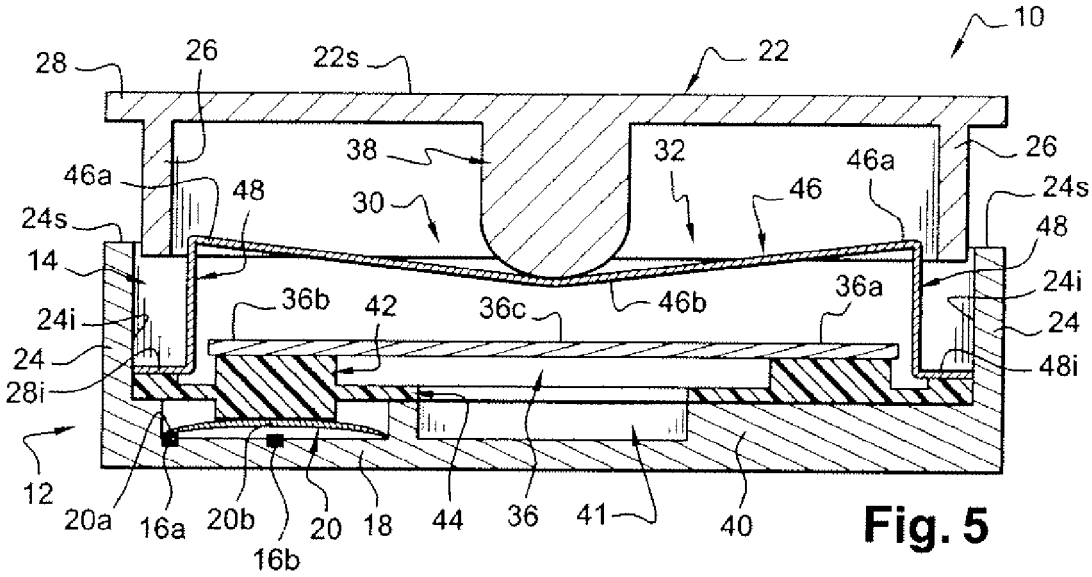
FIG. 5 depicts a view similar to that of FIG. 1, in which the mechanism is produced in two deformable elements according to an embodiment.

In an embodiment, the stiffness of the elastic endstop 42 may be determined such that the elastic endstop 42 may be elastically deformed on an additional downward displacement of the push-button 22. FIG. 5 depicts the final bottom position. In FIG. 5, the collar 28 of the push-button 22 may abut against the top edge 24*s* of the vertical walls 24 of the support 12. In an embodiment, the elastic endstop 42 may cooperate with the second blade 36 to limit the risk of damage to the triggering device 20.

In an embodiment, the stiffness of the elastic endstop 42 may be defined such that the elastic endstop 42 is elastically deformed when the push-button 22 is displaced downward from the intermediate actuating position. In an embodiment, the stiffness of the second blade 36 may be greater than that of the elastic endstop 42. Thus, on the downward displacement of the additional elastic element, the elastic endstop 42 may produce the additional elastic return force which may be added to the return force produced by the return device 32.

In an embodiment, the second blade 36 may be rigid, such that it is not deformed, regardless of the vertical position of the push-button 22. As a result, the elastic endstop 42 may be deformed on its own, as described previously, to produce the additional elastic force on the push-button 22. However, in an embodiment, if the second blade 36 is not deformed, the second blade 36 may act as a lever transmitting forces between the push-button 22 and the triggering device 20.

As depicted in FIGS. 1-5, the elastic endstop 42 may be roughly cylindrical in form with a main vertical axis. The elastic endstop 42 may be positioned substantially coaxial to the triggering device 20. In an embodiment, the elastic endstop 42 may include a horizontal portion 44 forming a spacer, which covers the entire bottom 18 of the recess 14, such that the second blade 36 may be able to bear on the horizontal portion 44 of the elastic endstop 42.

Figure 6:
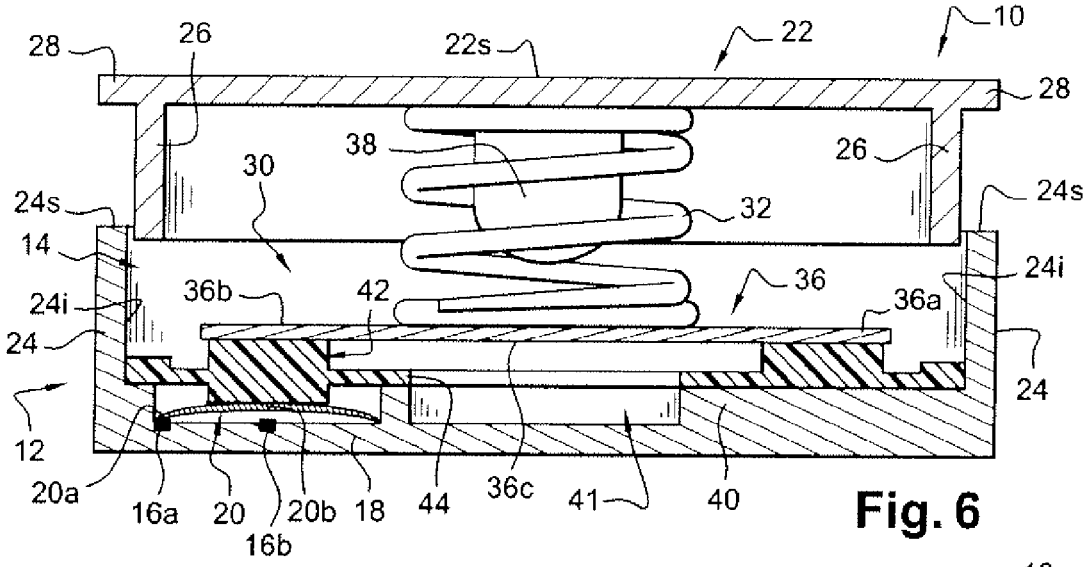
FIG. 6 depicts a view similar to that of FIG. 5, in which the return device includes a helical spring according to an embodiment.
Figure 7:
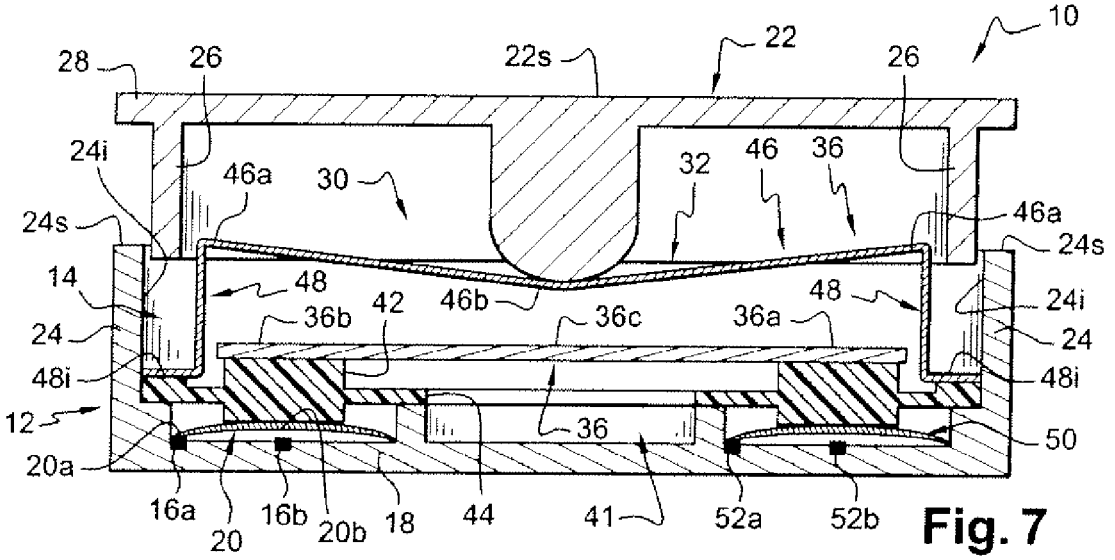
FIG. 7 depicts a view similar to that of FIG. 5, in which the switch comprises two triggering devices according to an embodiment.
Figure 8:
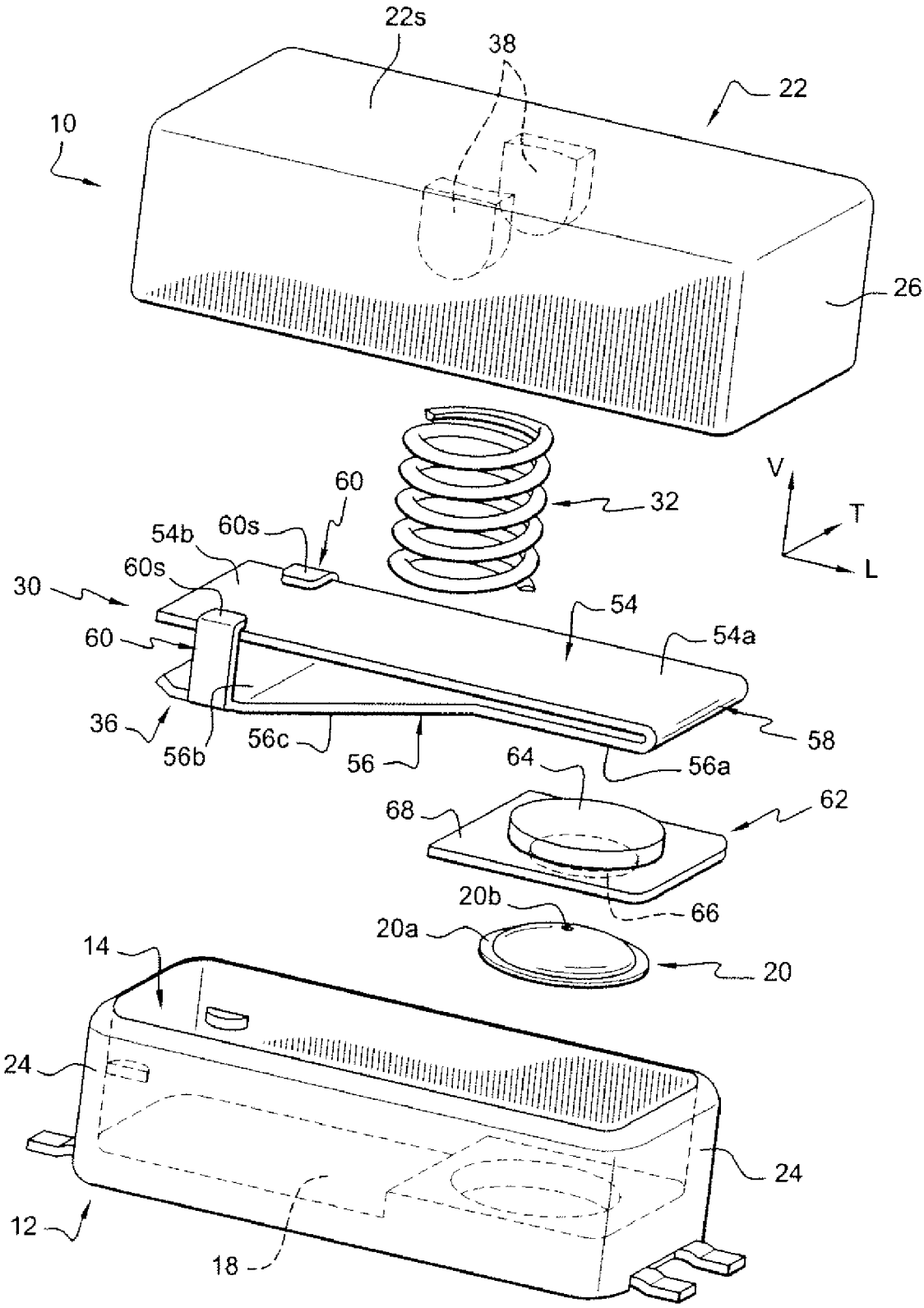
FIG. 8 depicts a diagrammatic representation in exploded perspective view of a switch according to an embodiment.

FIGS. 5-7 may depict embodiments in which the return mechanism 30 may include two separate elements or parts: the elastic device 32 and the second blade 36. According to FIG. 5, the elastic device 32 may include a substantially horizontal top portion 46 situated vertically away from the bottom 18 of the support 12 and on which the push-button 22 bears vertically downward via its digit 38. The elastic device 32 may also include lateral feet 48 extending vertically downward from the longitudinal ends 46*a* of the top portion 46. The bottom end 48*i* of each foot 48 may be bent horizontally outward and may bear on the bottom 18 of the support 12. In an embodiment, the elastic device 32 may be produced in a single piece by bending a sheet of elastic material.

In an embodiment, the second blade 36 may be immobile relative to the support 12 and may bear on the associated portion 40 of the bottom 18 of the support 12 and on the triggering device 20. Thus, when the push-button 22 is displaced downward from its top rest position, the elastic device 32 may be deformed without cooperating with the second blade 36. When the push-button 22 is in its intermediate contact position, the elastic device 32 may be deformed so as to enable the digit 38 of the push-button 22 to come into contact with the central portion 36*c* of the second blade 36. In an embodiment, a downward displacement of the push-button 22 beyond an intermediate contact position may cause the simultaneous deformation of both the elastic device 32 and the second blade 36 to limit the risk of damaging the triggering device 20.

In FIG. 6, the elastic mechanism 30 may be produced in two parts and the second blade 36 may be fixed relative to the support 12. In an embodiment, the return device 32 may include a helical spring. In an embodiment, the return device 32 may be positioned between the push-button 22 and the second blade 36. As stated above, the stillness of the second blade 36 may be greater than the stiffness of the elastic device 32.

In an embodiment, when the push-button slides downward, the elastic device 32 may be deformed more than the second blade 36, until the digit 38 comes into contact with the central portion 36*c* of the second blade 36. The push-button 22 may be in the intermediate contact position. On the downward displacement of the push-button 22, the push-button 22 may directly provoke the elastic deformation of the second blade 36, as described previously.

FIG. 7 depicts an embodiment similar to the embodiment represented in FIG. 5 according to an embodiment. In FIG. 7, the switch 10 may include a second triggering device 50 which can electrically link two secondary electrical contacts 52*a*, 52*b* under a user's force which may be transmitted by the push-button 22. The first and second triggering devices 20, 50 may be of similar design. In an embodiment, the first and second triggering devices 20, 50 may both be made of electrically conductive material and each may simultaneously come into contact with two associated electrical contacts 16*a*, 16*b* or 52*a*, 52*b*.

The second triggering device 50 may be a substantially upward-shaped dome and may constitute a disengageable endstop of the push-button 22 in a determined intermediate contact position. However, the second triggering device 50 may change states when the value of the force exerted by the user on the push-button 22 is greater than a second threshold value. The second threshold value may be different from the threshold value for which the first triggering device 20 changes state. This enables a user of the switch 10 to control consecutive actions. For example, in application to a camera, a user may control consecutive actions such as an initial focusing followed by the taking of the photograph.

In an embodiment, the user's force on the push-button 22 may be transmitted to each of the two triggering devices 20, 50 via the second blade 36. The first end 36*a* of the second blade 36 may be associated with a first triggering device 20 and the second end 36*b* of the elastic blade may be associated with the second triggering device 50. In an embodiment, the second blade 36 may bear on each of the two triggering devices 20, 50. The second blade 36 may transmit the force exerted by a user on the push-button 22 to each triggering device 20, 50 and may enable each triggering device 20, 50 to change state according to the value of the force on the part of the user.

In an embodiment, the second blade 36 may be subjected to an initial stress, or prestress, when the push-button 22 is in a position situated vertically above its contact position, i.e., between the rest position of the push-button 22 and the intermediate contact position. In an embodiment, the second blade 36 may be prestressed so that it exerts on the triggering device 20 a force, the value of which is less than the threshold value provoking a change of state of the triggering device 20, so the electrical link is made between the two associated contacts 16*a*, 16*b*; 52*a*, 52*b*.

When the push-button 22 reaches the intermediate contact position with the triggering device 20, via the second blade 36, the triggering device 20 may already be subjected to a force corresponding to the prestressing of the second blade 36. To provoke the change of state of the triggering device 20, a value of an additional force exerted by a user on the push-button 22 may correspond to the difference between the resistance threshold value of the triggering device 20, described hereinabove, and the value of the prestressing force exerted by the second blade 36. The additional force value may be determined. In an embodiment the additional force may be identical for several switches 10. When a user exerts the additional force, the second blade 36 may be elastically deformed to enable a vertical displacement of the push-button 22 according to a determined amplitude. In an embodiment, when the triggering device 20 changes state, the rapid downward displacement of the push-button 22 may be determined and may correspond to the vertical downward displacement of the peak of the triggering device 20.

In an embodiment, the prestressing of the second blade 36 may make it possible to determine the vertical position of the push-button 22 that corresponds to the contact position. In an embodiment, the prestressing of the second blade 36 may make it possible to determine the vertical position of the push-button 22 that corresponds to the actuating device triggering position. In an embodiment, the prestressing of the second blade 36 may make it possible to partly reduce the vertical travel of the push-button 22 on its displacement to the actuating position.

FIGS. 8-12 depict embodiments in which the elastically deformable blade 36 is produced by cutting and bending a metal strip. The elastically deformable blade 36 may include a first top part 54 in the form of an overall horizontal beam and a second bottom part 56 which is elastically deformable. The top part 54 may be produced to deform in a limited way or not be deformed, regardless of the vertical position of the push-button 22 relative to the support 12. The top part 54 may form an overall rigid beam. The top part 54 may be vertically displaced downward relative to the support 12 by a user acting on the triggering device 20 via the push-button 22.

In an embodiment, the triggering device 20 may be positioned to the right of the support 12. In embodiment, the right longitudinal end 54*a* of the top part 54 may be situated above and vertically away from the triggering device 20. The right longitudinal end 54*a* may act on the triggering device 20. The right longitudinal end 56*a* of the bottom part 56 may he linked to the right end 54*a* of the top part 54 via a curved part 58 so that the right longitudinal ends 54*a* and 56*a* of the two parts 54, 56 of the blade 36 are positioned one above the other and vertically separate from each other. The right longitudinal end 56*a* of the bottom part 56 may be situated above the triggering device 20. The right longitudinal end 56*a* of the bottom part 56 may be in contact with the peak 20*b* of the triggering device 20.

The left longitudinal end 56*b* of the bottom part 56 may bear downward against the bottom 18 of the support 12 so that the left longitudinal end 56*b* is situated vertically lower than the right longitudinal end 56*a*. The bottom part 56 may include an intermediate section 56*c* which may be inclined because of the height difference of the longitudinal ends 56*a*, 56*b* of the bottom part 56.

In an embodiment, the elastic device 32 may return the push-button 22 to the top rest position and may include a helical spring positioned roughly horizontally at the center of the switch 10. The push-button 22 may have two digits 38 between which the elastic device 32 can be received and by which the push-button 22 may act on the blade 36 to provoke a change of state for the triggering device 20.

Figure 9:
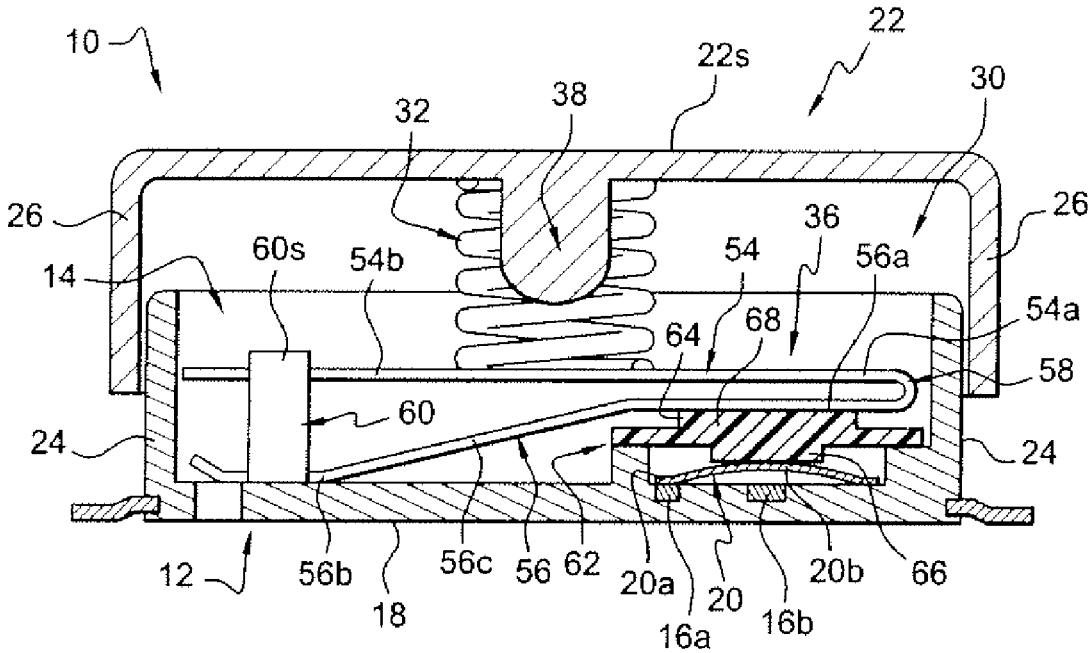
FIG. 9 depicts a cross section in a vertical longitudinal plane of the switch represented in FIG. 8, in which the push-button is in the top rest position according to an embodiment.

FIGS. 9-12 depict different actuating positions of the switch 10 according to an embodiment. In FIG. 9, the switch 10 may be represented in the rest position. The rest position may occur when a user is not acting on the push-button 22. The push-button 22 may be maintained in the top rest position, in which the push-button 22 is situated vertically away from the blade 36 by the force of the elastic device 32. In this position, the blade 36 may be in contact with the peak 20*b* of the triggering device 20, but not in contact with the associated fixed contact 16*b*.

Figure 10:
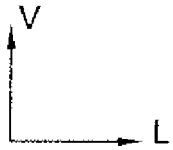
FIG. 10 depicts a view similar to that of FIG. 9, in which the push-button is in an intermediate contact position according to an embodiment.
Figure 10:
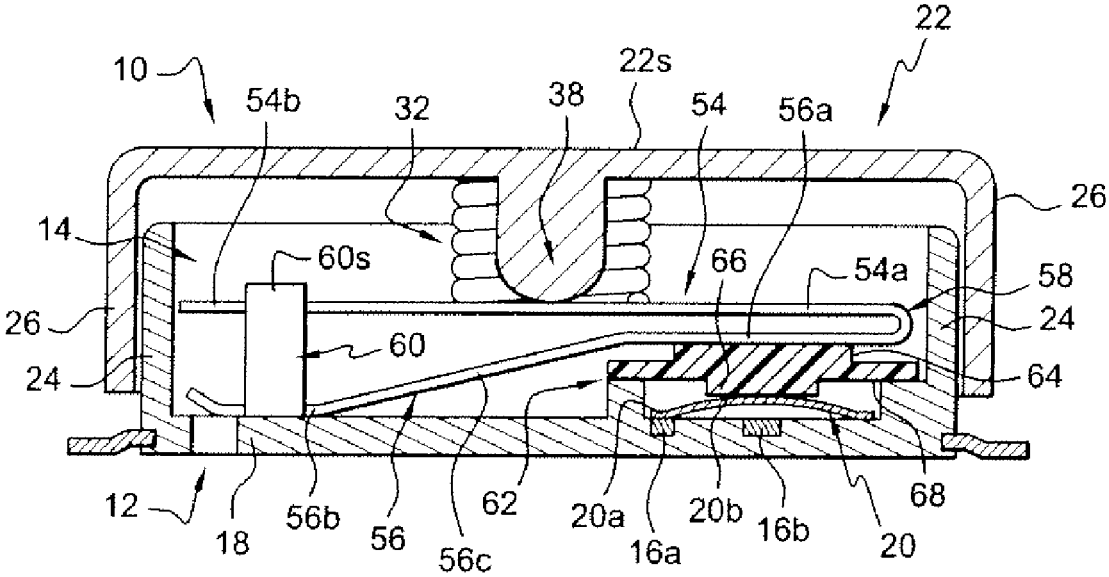

In an embodiment, a user may downwardly displace the push-button 22 from the rest position, depicted in FIG. 9, to the intermediate contact position, depicted in FIG. 10, in which the digits 38 may come into contact with the top part 54 of the blade 36. In an embodiment, during the downward displacement of the push-button 22, only the elastic device 32 may be deformed.

As depicted in FIG. 10, when the push-button 22 is in the contact position, the push-button 22 may be in contact with the triggering device 20 via the blade 36. When a user increases the amplitude of his force on the push-button 22, the force may change the state for the triggering device 20 causing an electrical link to be made between the two fixed contacts 16*a*, 16*b*.

Figure 11:
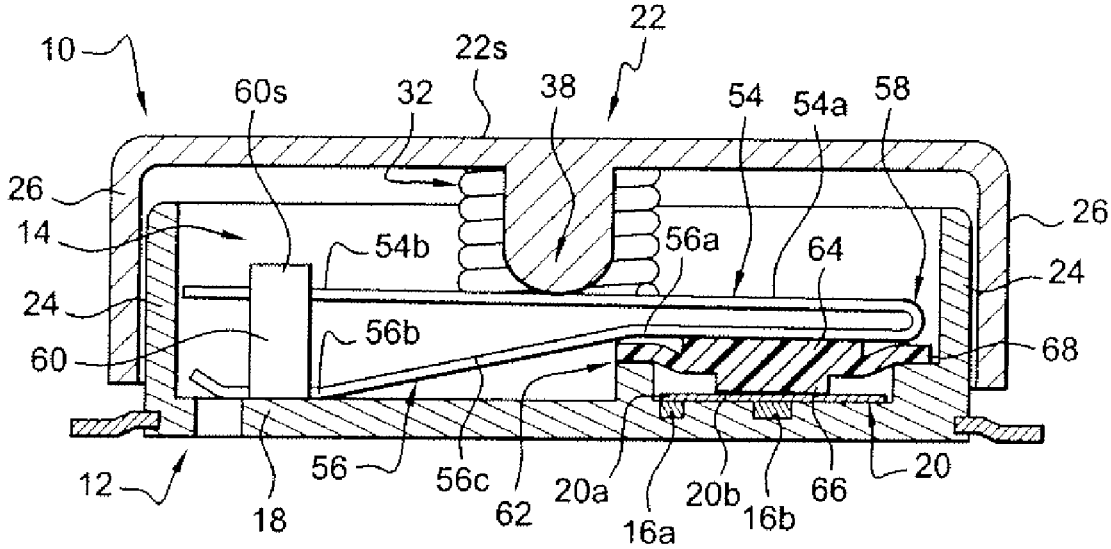
FIG. 11 depicts a view similar to that of FIG. 9, in which the push-button is in an intermediate triggering device actuating position according to an embodiment.
Figure 12:
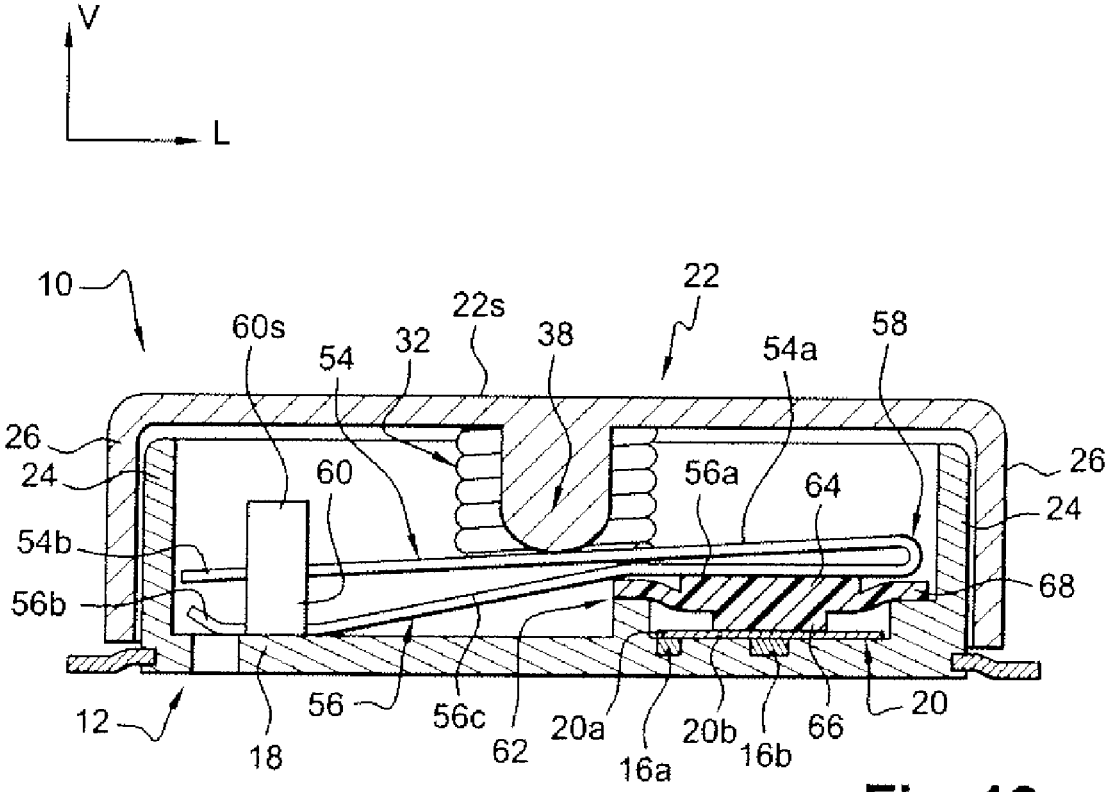
FIG. 12 depicts a view similar to that of FIG. 9, in which the push-button is situated vertically beyond an intermediate triggering device actuating position according to an embodiment.

As a result of the change of state of the triggering device 20, the push-button 22 may be displaced downward, driving part of the blade 36 to the actuating position depicted in FIG. 11. In an embodiment, the blade 36 may be deformed so that the right longitudinal ends 54*a*, 56*a* of its two parts 54, 56 are displaced downward. When a user continues his force on the push-button 22, the push-button 22 may be displaced downward beyond the actuating position, as depicted in FIG. 12, and the blade 36 may be elastically deformed.

To enable the top part 54 of the blade 36 to be displaced downward, the bottom part 56 and the curved part 58 may be deformed elastically, such that the left longitudinal end 54*b* of the top part 54 is displaced downward. The blade 36 may also be subjected to a pre-stressing when the push-button 22 is in a position situated above the contact position.

In an embodiment, the bottom part 56 of the blade 36 may include two hooks 60 which extend vertically upward from the left longitudinal end 56*b* of the bottom part 56. The top end 60*s* of each hook 60 may be bent transversally so as to bear downward against the left end 54*b* of the bottom part 54. The blade 36 may be designed so that the hooks 60 maintain the top pan 54 in a position for which the curved part 58 and the bottom part 56 are elastically deformed and exert on the top part 54 an initial upwardly directed force. Since the blade 36 may be subjected to such pre-stressing, a user may exert a force on the push-button 22 which has an amplitude greater than the amplitude of the pre-stressing to provoke a downward displacement of the push-button 22 beyond the actuating position. Additionally, the pre-stressing of the blade 36 may make it possible to cancel the various vertical positioning plays of its parts 54, 56 relative to the support 12 and relative to the triggering element 20.

In an embodiment, it may be possible to determine relatively reliably the vertical position of the push-button 22 corresponding to each actuation level of the switch 10. In an embodiment, it may be possible to effectively define the various vertical travels of the push-button 22 in order to obtain an actuator 10 with a small footprint.

As depicted in FIGS. 9-12, the right end 56*a* of the bottom part 56 may be substantially flat. The right end 56*a* may act on the triggering device 20 to provoke the change of state. When the triggering device 20 is in its deformed position, the triggering device 20 may substantially form a radial undulation centered on its main vertical axis. Thus, when the push-button 22 is in the intermediate triggering position, the bottom face of the right end 56*a* of the bottom part 56 may bear against a radially intermediate portion of the triggering device 20, and may be situated vertically away from the peak 20*b* of the triggering device 20. The right end 56*a* of the bottom part 56 may not press downward sufficiently on the peak 20*b* of the triggering device 20, and the bottom part 56 may not come into contact with the associated electrical contact 16*b*.

As a result, the switch 10 may include an intermediate actuator 62 which is positioned vertically between the right end 56*a* of the bottom part 56 and the triggering device 20, such that it transmits the operating forces between the right end 56*a* of the bottom part 56 and the triggering device 20. In an embodiment, the intermediate actuator 62 may be joined to the right end 56*a* of the bottom part 56 to be used during downward displacement of the triggering device 20. The intermediate actuator 62 may include a top portion 64 on which the right end 56*a* of the bottom part 56 may bear downward. In an embodiment, the top portion 64 may be substantially horizontal and circular. The intermediate actuator 62 may also include a bottom portion 66 which may bear on the triggering device 20. In an embodiment, the bottom portion 66 may be substantially horizontal and circular. In an embodiment the diameter of the bottom portion 66 may be relatively small making it possible to concentrate the force transmitted by the intermediate actuator 62 at the level of the peak 20*b* of the triggering device 20.

In an embodiment, the intermediate actuator 62 may include a flat intermediate portion 68 which bears against the bottom 28 of the support 12. The intermediate portion 68 may be elastically deformable to upwardly return the top portion 64 and the bottom portion 66 when the user stops acting on the actuator 10.

Figure 13:
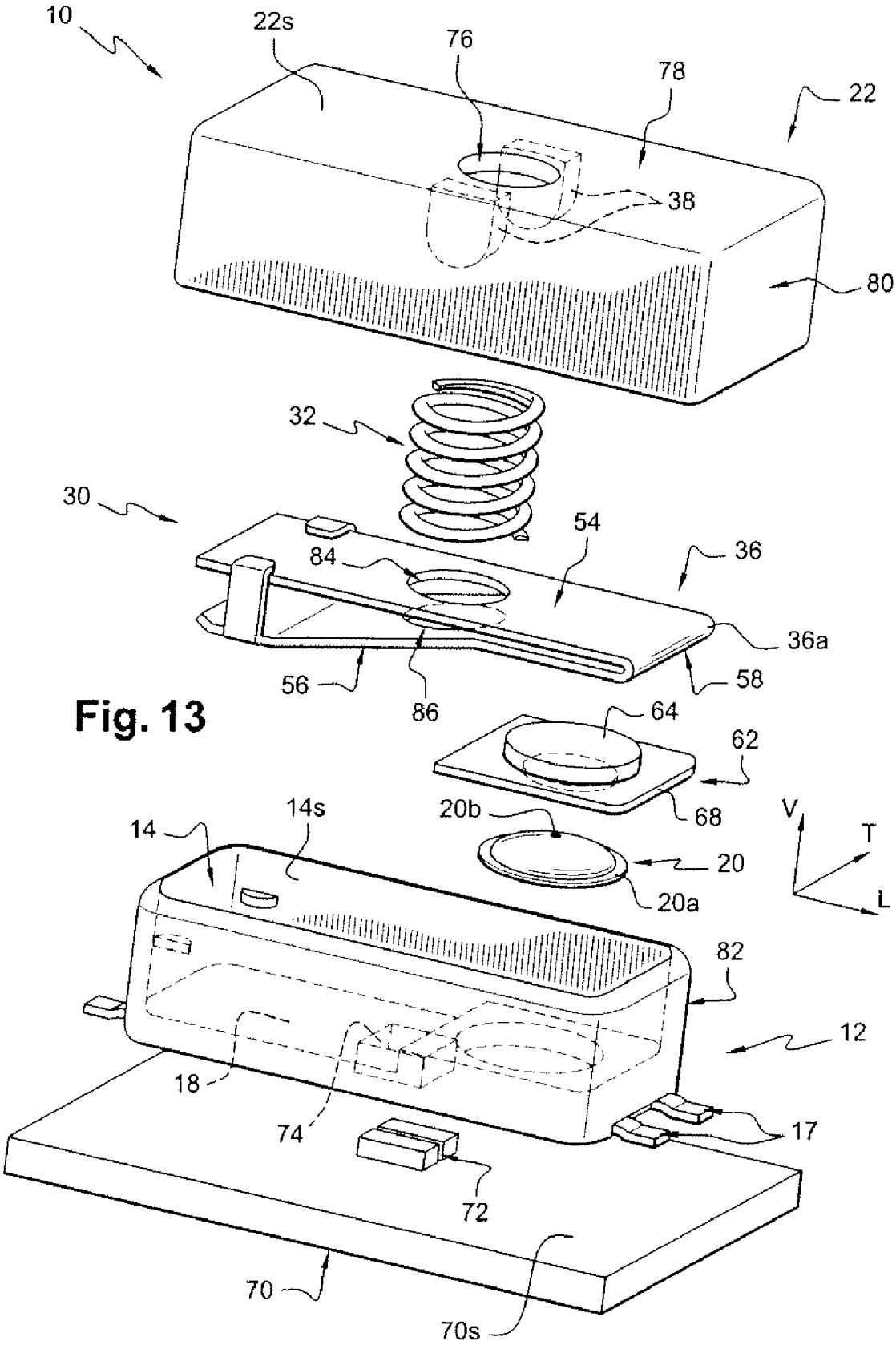
FIG. 13 depicts a diagrammatic representation of a switch in an exploded perspective according to an embodiment.
Figure 14:
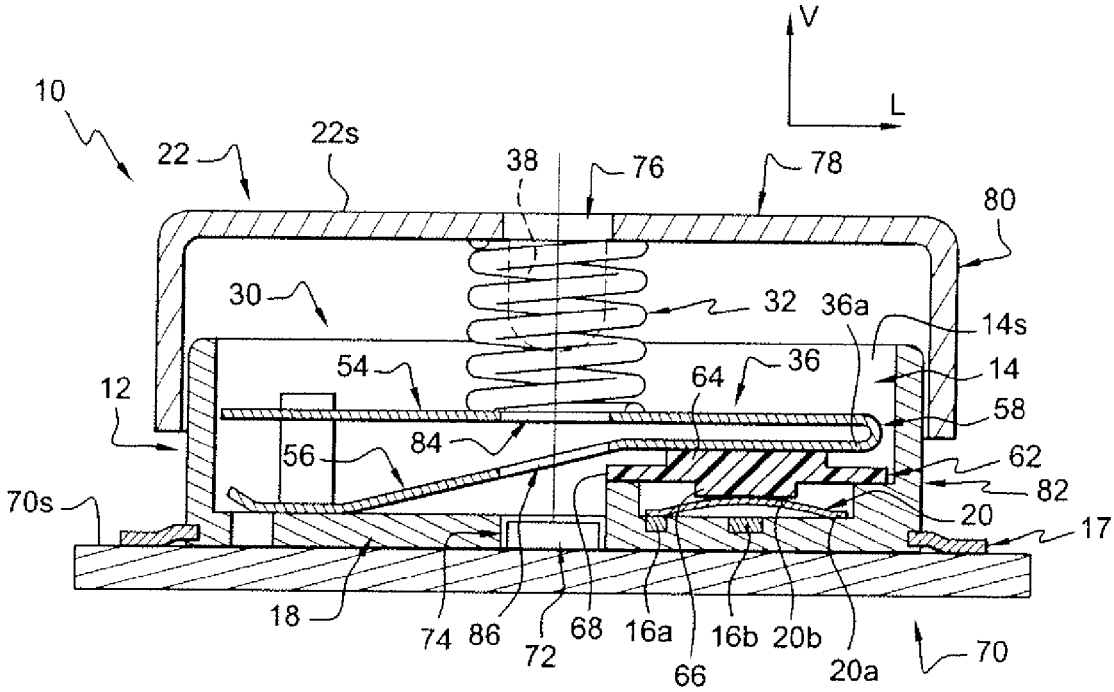
FIG. 14 depicts a cross section in a vertical longitudinal plane of the switch represented in FIG. 13 according to an embodiment.

FIGS. 13 and 14 depict embodiments where the switch 10 is mounted on the top face 70*s* of a plate supporting electronic components 70. A light source 72, which may be mounted on the top face 70*s* of the plate supporting electronic components 70, may produce a light flux in the recess 14 of the support 12. The support 12 may include a horizontal bottom 18 which may bear fixed contacts 16*a*, 16*b* and the triggering device 20 may bear on the top face 70*s* of the plate supporting electronic components 70 when the switch 10 is mounted on the plate supporting electronic components 70.

In an embodiment, to enable the light source 72 to produce a light flux directly in the recess 14 of the support 12, the bottom 18 of the support 12 may include an opening 74 with which the light source 72 can pass through. In an embodiment, the light source 72 may be surrounded be the bottom 18 of the support 12 so that the light flux is produced only in the recess 14 of the support 12 and may leave only through the top opening 14*s* of the recess 14. In an embodiment, the opening 74 in the bottom 18 may be situated horizontally in the middle of the bottom 18. To enable the light flux produced by the light source 72 to leave the recess 14, the push-button 22 may include a light-permeable window 76 which at least a part of the light flux can pass through.

In an embodiment, the push-button 22 and the support 12 may have overall complementary forms, so that the push-button 22 may completely block the top opening 14*s* of the recess 14. In an embodiment, the push-button 22 may include a horizontal top wall 78 which blocks the top opening 14*s* of the recess 14 and peripheral walls 80 which extend vertically downward from the peripheral edges of the top wall 78.

In FIG. 14, the push-button 22 may cover the support 12. In an embodiment, the peripheral walls 80 of the push-button 22 may be situated outside the support 12. The support 12 may also include vertical walls 82 which extend vertically upward from the bottom 18. The vertical walls 82 of the support 12 may form a cylindrical strip with a main vertical axis. The peripheral walls 80 of the push-button 22 may also form a cylindrical strip with a main vertical axis, which is coaxial to the cylindrical strip formed by the vertical walls 82 of the support 12. In an embodiment, the support 12 and the push-button 22 may be made of opaque material, such that the light flux, which is produced by the light source, can leave the recess 14 only through the window 76 provided in the push-button 22.

In an embodiment, the window 76 may be formed in the top wall 78 of the push-button 22 and may be situated horizontally in the middle of the top wall 78. In an embodiment, a window 76 may be situated vertically in line with the opening 74 in the bottom 18 and with the light source 72. In an embodiment, the window 76 may be circular and centered in the middle of the top wall 78.

In an embodiment, the top wall 78 of the push-button 22 may include a plurality of windows 76 which are distributed within the top wall 78. In an embodiment, the window 76 may be of complex form, for example, but not limited to, the form of a symbol or an alphanumeric character. In an embodiment, the window 76 may not be situated in the middle of the top wall 78 of the push-button 22.

In FIGS. 13 and 14, the window 76 may he situated vertically in line with the light source 72. In an embodiment, the top part 54 and the bottom part 56 of the blade 36 may be situated between the light source 72 and the window 76.

In FIG. 14, the top part 54 and the bottom part 56 of the blade 36 may each include an orifice 84, 86. The orifices 84, 86 may be aligned with the light source 72 and the window 76. In an embodiment, the orifices 84, 86 may be situated in line with the light source 72.

In an embodiment, the blade 36 may not form an obstacle to the light flux produced by the light source 72 which is intended to leave through the window 76. In an embodiment, as stated above, the elastic device 32 and the digits 38 may be situated longitudinally in the middle of the support 12 and/or the push-button 22. In an embodiment, the elastic device 32 and the digits 38 may be situated longitudinally at the level of the light source 72 and of the window 76. For the elastic device 32 and the digits 38 not to form an obstacle to the light flux, the latter may be substantially offset transversally relative to the window 76. Thus, as depicted in FIG. 13, the elastic device 32 may include a helical spring with a main vertical axis horizontally centered with the window 76 and the digits 38 may be distributed transversally on either side of the window 76.

In an embodiment, the elastic device 32, the orifices 84, 86 and the positioning of the digits 38 of the support 22 overall may define a pathway linking the light source 72 to the window 76 so that the part of the light flux which leaves the recess 14 through the window 76 undergoes as little attenuation as possible.

In an embodiment, the switch 10 may include an element to guide the light flux produced by the light source 72 to the window 76 and through the orifices 84, 86. This element that forms a light guide may direct the light to the window 76 when components of the switch 10 are situated between the light source 72 and the window 76. In an embodiment, the light-guide element may form a single component with the window 76.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. An electrical switch system comprising:

a contact-bearing support configured to delimit a recess in a substantially horizontal bottom, wherein at least two fixed electrical contacts are positioned in the recess;

at least one dome-shaped first triggering device configured to be elastically deformable, in a substantially vertical direction, from a top rest position to form an electrical link between the at least two fixed electrical contacts;

an actuating push-button mounted to be displaced substantially vertically downward relative to the support, from a rest position in which the push-button is not in contact with the first triggering device, to a number of successive positions, including a first actuating position of contact with the first triggering device, and a second actuating position in which the push-button acts on the first triggering device so that the first triggering device is elastically deformed to make the electrical link between the at least two fixed electrical contacts;

a mechanism configured to return the push-button to the rest position, wherein the mechanism is configured to exert an elastic return force on the push-button, wherein the elastic return force is directed substantially vertically upward; and an elastic element configured to exert an elastic force on the push-button, wherein the elastic force is directed upward when the push-button is displaced downward beyond a contact position.

2. The system of claim 1 wherein the elastic element is further configured to be subject to an initial stress at least when the push-button is situated vertically above an intermediate contact position.

3. The system of claim 1 wherein the elastic element is further configured to be positioned between the first triggering device and the push-button, such that the elastic element is elastically deformed if the push-button is displaced beyond the first actuating position.

4. The system of claim 1 wherein the elastic element is further configured to form an elastic lever for transmitting a force of the push-button to the first triggering device, wherein the elastic lever is bearing on the support, at least when the actuating push-button is in a vertical position situated vertically downward, beyond the contact position.

5. The system of claim 1 wherein the elastic element is further configured to move relative to the support, from a rest position to which it is elastically returned, to the contact position associated with the first actuating position of the push-button, wherein the elastic element is bearing on the support, and wherein the elastic element is elastically deformed when the actuating push-button is displaced beyond the first actuating position.

6. The system of claim 5 wherein the elastic element is further configured to be driven from the rest position to the first contact position via the push-button.

7. The system of claim 1 wherein the mechanism comprises an elastic return device which is configured to exert the elastic return force on the push-button to return the elastic element to the rest position.

8. The system of claim 7 wherein the elastic element is further configured to be positioned between the push-button and the elastic return device.

9. The system of claim 7 wherein elastic element and the elastic return device are further configured to be produced in one piece by cutting and bending a piece of elastic material.

10. The system of claim 7 wherein the elastic element comprises a greater stiffness than the elastic return device.

11. The system of claim 1 wherein the elastic element is further configured to be in permanent contact with the support and with the first triggering device.

12. The system of claim 1 wherein the elastic element is further configured to exert a force on the first triggering device which does not make the electrical link between the two or more fixed contacts.

13. The system of claim 1 wherein the elastic element is further configured to be in direct contact with the first triggering device to transmit a force from the push-button to provoke a deformation of the first triggering device.

14. The system of claim 1 wherein the elastic element is further configured to be in contact with the first triggering device via a damping element to transmit a force of the push-button to the first triggering device.

15. The system of claim 1 wherein:

the elastic element comprises a first end which bears against the first triggering device and a second end which bears against the support; and the push-button is configured to bear on an intermediate portion of the elastic element situated between the first end and the second end of the elastic element, when the push-button slides downward from the contact position.

16. The system of claim 1 wherein the first triggering device is configured to form a disengagable endstop of the push-button in the first contact position, which changes state when the push-button exerts a force of a value greater than a predetermined threshold value on the first triggering device.

17. The system of claim 1 further comprises a second triggering device, wherein the first triggering device and the second triggering device bear the elastic element, and wherein a first threshold value associated with the first triggering device is different from the second threshold value associated with the second triggering device, wherein the first triggering device exceeds the first threshold value to provoke a change of state of the first triggering device and the second triggering device exceeds the second threshold value to provoke a change of state of the second triggering device.

* * * * *